US010122135B2

(12) United States Patent
Trio et al.

(10) Patent No.: US 10,122,135 B2
(45) Date of Patent: Nov. 6, 2018

(54) PLUG CONNECTOR DEVICE HAVING A WIRING BLOCK WITH AT LEAST ONE RECEIVING REGION

(71) Applicant: Reichle & De-Massari AG, Wetzikon (CH)

(72) Inventors: Fabio Trio, Jona (CH); Marco Zurkirchen, Bubikon (CH)

(73) Assignee: Reichle & De-Massari AG, Wetzikon (CH)

( * ) Notice: Subject to any disclaimer, the term of this patent is extended or adjusted under 35 U.S.C. 154(b) by 0 days.

(21) Appl. No.: 15/112,211

(22) PCT Filed: Dec. 18, 2014

(86) PCT No.: PCT/EP2014/078568

§ 371 (c)(1),
(2) Date: Jul. 18, 2016

(87) PCT Pub. No.: WO2015/106926

PCT Pub. Date: Jul. 23, 2015

(65) Prior Publication Data

US 2016/0336699 A1 Nov. 17, 2016

(30) Foreign Application Priority Data

Jan. 20, 2014 (DE) ..... 10 2014 100 544

(51) Int. Cl.
*H01R 24/00* (2011.01)
*H01R 24/64* (2011.01)
(Continued)

(52) U.S. Cl.
CPC ..... *H01R 24/64* (2013.01); *H01R 4/2416* (2013.01); *H01R 9/03* (2013.01); *H01R 13/4532* (2013.01);
(Continued)

(58) Field of Classification Search
CPC ..... H01R 13/5804; H01R 13/6464; H01R 13/6466; H01R 13/5841; H01R 13/6592; H01R 24/62; H01R 24/64; H01R 4/2416
(Continued)

(56) References Cited

U.S. PATENT DOCUMENTS 4,476,629 A 10/1984 Suzuki et al.
4,836,803 A * 6/1989 Seidel ..... H01R 4/242 439/447

(Continued)

FOREIGN PATENT DOCUMENTS

CN 1197203 C 4/2005
DE 102009053364 B3 1/2011

(Continued)

OTHER PUBLICATIONS

German Search Report dated Sep. 22, 2014 issued in corresponding DE patent application No. 10 2014 100 544.9 (and partial English translation).

(Continued)

*Primary Examiner* — Hae Moon Hyeon
(74) *Attorney, Agent, or Firm* — Posz Law Group, PLC

(57) ABSTRACT

A plug connector device includes one or more wiring block(s) which is provided for receiving one or more multi-wire data cable(s). The wiring block includes one or more receiving region(s) for receiving one or more wire(s) of the multi-wire data cable(s). The receiving region is at least partly delimited by one or more receiving element, which is at least partly deformable. The one or more receiving element(s) includes one or more first receiving piece(s), which is implemented at least partly elastically and/or plastically deformable. The receiving region(s) includes one or more second receiving piece(s) including one or more holding lug(s), which is at least partly provided for fastening
(Continued)

Figure 1:
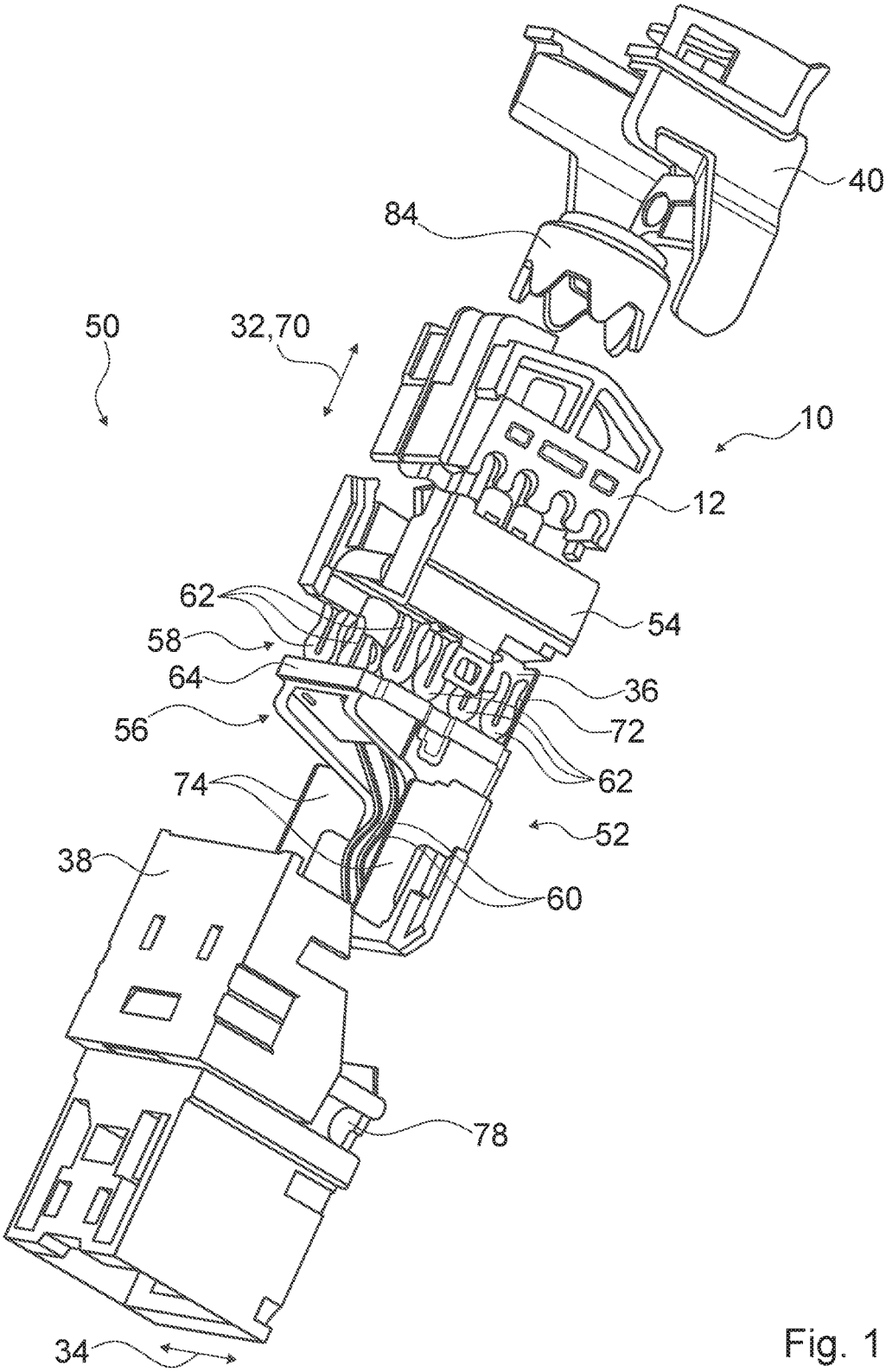

respectively one wire of the multi-wire data cable(s) in a form-fit manner. The first receiving piece at least partly has a first rigidity, the second receiving piece at least partly has a second rigidity different from the first rigidity.

18 Claims, 7 Drawing Sheets

(51) Int. Cl.
*H01R 4/2416* (2018.01)
*H01R 13/453* (2006.01)
*H01R 13/58* (2006.01)
*H01R 13/6592* (2011.01)
*H01R 9/03* (2006.01)

(52) U.S. Cl.
CPC ..... *H01R 13/5841* (2013.01); *H01R 13/6592* (2013.01)

(58) Field of Classification Search
USPC ..... 439/451, 676
See application file for complete search history.

(56) References Cited

U.S. PATENT DOCUMENTS 5,199,891 A * 4/1993 Reed ..... H01R 9/034 439/452
5,211,706 A 5/1993 Polgar
6,056,586 A * 5/2000 Lin ..... H01R 13/582 439/460
6,203,362 B1 * 3/2001 Tsuji ..... H01R 13/506 439/470
6,604,861 B2 * 8/2003 Chen ..... G02B 6/3869 385/56
6,953,362 B2 * 10/2005 Mossner ..... H01R 4/2433 439/395
7,195,518 B2 * 3/2007 Bert ..... H01R 4/2441 439/290
7,404,739 B2 * 7/2008 Sheilds ..... H01R 4/2441 439/290
7,452,245 B2 * 11/2008 Doorhy ..... H01R 13/6463 439/456
7,537,478 B2 * 5/2009 Foltz ..... H02G 3/0487 439/466
7,578,695 B2 * 8/2009 Boeck ..... H01R 13/5804 439/460
7,621,772 B1 * 11/2009 Tobey ..... H01R 13/58 174/660
7,625,224 B2 * 12/2009 Jaouen ..... H01R 13/65802 439/98
7,713,081 B2 * 5/2010 Chen ..... H01R 9/037 439/409
7,892,018 B1 * 2/2011 Tobey ..... H01R 24/64 439/441
8,262,406 B2 * 9/2012 Lindkamp ..... H01R 13/506 439/462
8,376,779 B2 * 2/2013 Metral ..... H01R 13/502 439/607.41
8,568,159 B2 * 10/2013 Noda ..... H01R 13/562 439/470
8,834,196 B2 * 9/2014 Duran ..... H01R 9/032 439/459
9,520,692 B2 * 12/2016 Valenti ..... H01R 4/2416
2003/0171024 A1 9/2003 Mossner et al.
2009/0223041 A1 9/2009 Garrison et al.
2011/0028024 A1 * 2/2011 Lu ..... H01R 4/2433 439/395
2011/0212652 A1 9/2011 Schmidt et al.
2013/0072055 A1 * 3/2013 Pedruzzi ..... H01R 9/032 439/470

FOREIGN PATENT DOCUMENTS

EP 0027696 A1 4/1981
EP 0569918 A1 11/1993
EP 0727849 A2 8/1996
EP 1 883 137 A2 1/2008
EP 2045884 A1 4/2009
JP 8-273719 A 10/1996
JP H08-273719 A 10/1996
JP 11-329575 A 11/1999
JP 2008-541354 A 11/2008
JP 2010-541182 A 12/2010
WO 02/15339 A1 2/2002
WO 2008/071917 A1 6/2008
WO 2013/029752 A1 3/2013

OTHER PUBLICATIONS

International Search Report dated Jul. 2, 2015 issued in the corresponding International application No. PCT/EP2014/078568.
International Preliminary Report on Patentability dated Dec. 18, 2014 issued in the corresponding International application No. PCT/EP2014/078568.
Examination Report dated May 19, 2017 issued in corresponding AU application No. 2014377399.
Letter explaining the content of the AU Examination Report.
Office Action dated Jun. 27, 2017 issued in corresponding EP application No. 14835553.0 (and partial English translation).
Extended European Search Report dated Jun. 28, 2017 issued in related EP application No. 17168188.5 (and partial English translation).
Extended European Search Report dated Jun. 28, 2017 issued in related EP application No. 17168192.7 (and partial English translation).
Extended European Search Report dated Jun. 28, 2017 issued in related EP application No. 17168194.3 (and partial English translation).
Office Action dated Dec. 29, 2017 issued in corresponding CN patent application No. 201480073678.0.
Japanese Office Action dated Sep. 19, 2017 for the corresponding JP application No. 2016-564387 (English summary attached).
Australian Office Action dated Sep. 7, 2017 for the corresponding AU application No. 2014377399.

* cited by examiner

PLUG CONNECTOR DEVICE HAVING A WIRING BLOCK WITH AT LEAST ONE RECEIVING REGION

CROSS REFERENCE TO RELATED APPLICATIONS

This application is a U.S. national stage application of PCT/EP2014/078568 filed on Dec. 18, 2014, which is based on German Patent Application No. 10 2014 100 544.9 filed on Jan. 20, 2014, the contents of which are incorporated herein by reference.

BACKGROUND OF THE INVENTION

The invention relates to a plug connector device, in particular a Registered Jack (RJ) plug connector device, with at least one wiring block.

Plug connector devices for RJ plug connectors are already known, in which wires of a data cable have to be pressed separately into insulation displacement contacts (IDC) by an operator by means of a lay-upon hand tool.

BRIEF SUMMARY OF THE INVENTION

The objective of the invention is in particular to make a generic plug connector device available, in which a wiring of a wiring block with at least one wire of the data cable is implemented in a simplified fashion. The objective is achieved according to the invention by the features of the claims, while advantageous embodiments and further developments of the invention may be gathered from the subclaims.

A plug connector device, in particular RJ plug connector device, is proposed, with at least one wiring block which is provided for receiving at least one multi-wire data cable and comprises at least one receiving region for receiving at least one wire of the at least one data cable.

The wiring block is advantageously provided for receiving all wires of the multi-wire data cable, in particular in the at least one receiving region, preferably respectively separately in a plurality of receiving regions. Preferentially the wiring block is provided to be slid, in assembly, into a plug connector that is preferably embodied by a plug socket, in particular from the rear or counter to a plug-in direction of a data plug, wherein the at least one wire of the data cable can be contacted by at least one insulation displacement contact (IDC).

By a "data cable" is to be understood, in this context, in particular an element, in particular a flexible, preferably insulated, electric line and/or an optical wave guide, which element is provided at least partly for transferring an electric signal, in particular a preferably digital, in particular high-frequency information. The data cable may be provided preferably for a bi-directional communication. In a preferred exemplary embodiment the at least one wire of the data cable is implemented at least to a large part of copper. However, other implementations of the data cable, which are deemed expedient by a person having ordinary skill in the art, e.g. in particular made at least partly of aluminum, are also conceivable. In a particularly preferred exemplary embodiment the data cable can be introduced, viewed in a introduction direction, into at least part of the wiring block and can preferably be at least partly fastened in the wiring block subsequently. The introduction direction preferably extends along a longitudinal direction of the data cable, in which longitudinal direction furthermore the at least one wire is guided at least to a large part inside the data cable.

"Provided" is to mean in particular specifically implemented, designed and/or equipped. By an element or a unit being provided for a certain function is in particular to be understood that the element or the unit implements and/or executes said certain function in at least one application state and/or operation state.

A "receiving region" is to be understood, in this context, in particular as a region of the wiring block which is provided for at least partly holding the at least one wire of the data cable in a form-fit and/or force-fit fashion, in particular in at least two spatial directions. A "form-fit and/or force-fit fashion" is to mean, in this context, in particular that the at least one wire of the data cable is at least partly releasably held in the at least one receiving region, a holding force between the at least one wire and the at least one receiving region being transferred preferably by the structural components engaging one into the other and/or by a friction force between the structural components.

By such an implementation a preferentially simple, operator-friendly and advantageously time-saving wiring of the plug connector device is achievable.

It is further proposed that the at least one receiving region is at least partly delimited by an at least partly deformable receiving element. By "at least partly deformable" is to be understood, in this context, in particular that the at least one receiving element can be at least partly brought into a shape that deviates from a shape of the receiving element in a load-free state by way of a force by an operator, in particular at least to a large part without further assisting means, onto the at least one receiving element, in particular when the at least one wire of the data cable is introduced into the at least one receiving element, wherein in particular a reversible, in particular elastic, or an irreversible, in particular plastic deformation and/or a damaging of the receiving element may occur. Preferably the at least one receiving element is deformable by at least 0.01 mm, in particular by at least 0.1 mm, preferably by at least 0.5 mm, preferentially by at least 1 mm and particularly preferably by at least 5 mm with respect to a shape and/or contour in a load-free state. The at least one receiving element is herein deformable at least partly plastically and irreversibly, for example by at least part of the at least one receiving element rupturing or breaking off of, and/or deformable in an elastic and reversible fashion.

"At least partly delimiting" is to mean, in this context, in particular that the at least one receiving region of the at least one receiving element is at least partly delimited from an environment and/or from adjacent structural components and/or regions in particular on at least two, preferably on at least three, preferentially on at least four and particularly preferably on at least five sides, which are arranged perpendicularly to each other. In this way a preferably simple and reliable implementation of the receiving region is achievable.

Furthermore it is proposed that the at least one receiving element comprises at least one first receiving piece, which is implemented at least partly elastically and/or plastically deformable. By a "receiving piece" is to be understood in particular a component, in particular a solid component, and/or a partial region of the at least one receiving element. "Elastically deformable" is to mean, in particular, that the at least one receiving element is repeatedly deformable without resulting in mechanical damaging or destruction of the at least one receiving element, and, in particular following a deformation, autonomously or automatically aims at regaining an original shape. In this way an advantageously secure and stable receiving of the at least one wire of the data cable in the at least one receiving piece of the at least one receiving element as well as a preferably flexible implementation of the receiving element are achievable.

It is moreover proposed that the at least one first receiving piece is embodied at least partly in a lamellar fashion. By "lamellar" is to be understood, in this context, in particular that the at least one receiving element has at least partly a small material extension in particular of no more than 7 mm, preferably maximally 5 mm, preferentially no more than 3 mm and particularly preferably maximally 1 mm, preferably along an extension of in particular at least 5 mm, preferably at least 7 mm, preferentially at least 10 mm and particularly preferably at least 15 mm. This allows achieving a constructively simple, preferentially operator-friendly and advantageously cost-competitive implementation of the at least one first receiving piece of the at least one receiving element, and a preferably great range of diameters of the at least one wire which can be received in the at least one first receiving piece of the receiving element.

In a further implementation of the invention it is proposed that the at least one receiving element comprises at least one second receiving piece comprising at least one holding lug, which is at least partly provided for fastening respectively one wire of the at least one data cable in a form-fit manner. Preferably the at least one second receiving piece is implemented at least partly elastically and/or plastically deformable. Preferably the first receiving piece also has at least one holding lug at least partly provided for fastening respectively one wire of the at least one data cable in a form-fit manner. A "holding lug" is to be understood, in this context, in particular as a mechanical element which is arranged at, in particular molded to, the at least one second receiving piece of the at least one receiving element. "In a form-fit manner" is to mean in particular that in at least one state adjacent surfaces of structural components, which are connected to each other in a form-fit manner, exert onto each other a holding force acting in a normal direction of the surfaces. In particular, the structural components geometrically engage with each other in the at least one state. The at least one first receiving piece and the at least one second receiving piece are embodied at least partly separate. It is however also conceivable that the at least one first receiving piece and the at least one second receiving piece are implemented by the same part of the at least one receiving element. This allows achieving a constructively simple form-fit fixation of the at least one wire of the data cable. In particular by double positioning of the at least one wire of the at least one data cable by the at least one first receiving piece and the at least one second receiving piece of the at least one receiving element, an advantageously precise and constant wiring quality by at least one insulation displacement contact (IDC) is achievable.

Furthermore it is proposed that the at least one first receiving piece and the at least one second receiving piece are embodied at least partly having different rigidities. Preferably one of the at least two receiving pieces is provided, in particular at least to a large part, rather for a force-fit holding, and the other one of the at least two receiving pieces is provided, in particular to a large part, rather for a form-fit holding of the at least one wire. In particular the at least one first receiving piece is rather provided for a force-fit holding, and the at least one second receiving piece is rather provided for a form-fit holding of the at least one wire. In particular the at least one first receiving piece is embodied at least partly more rigid than the at least one second receiving piece. This allows achieving a preferably reliable fixation of the at least one wire of the data cable.

It is also proposed that the at least one wiring block comprises at least one drain wire receiving element, which is provided for receiving a drain wire of the data cable. By a "drain wire" is to be understood, in this context, in particular an at least partly electrically uninsulated bare wire running inside the data cable, at least partly contacting the at least one wire, in particular an insulation of the at least one wire, and provided for transferring in an operating state of the data cable induced interference signals away from the at least one wire at least partly, preferably at least to a large part. In this way contacting of the drain wire is achievable preferentially near an interface of the data cable with the wiring block, in particular preferably near an insulation and/or an exterior shielding of the data cable, thus allowing to achieve an advantageously good and preferably interference-free data transmission.

It is also proposed that the at least one drain wire receiving element is embodied at least partly groove-shaped. The at least one drain wire receiving element preferably at least partly comprises a semi-circular or pitch-circular cross-sectional contour and is thus embodied at least partly trough-shaped. It is however also conceivable that the at least one drain wire receiving element has an at least partly V-shaped, rectangular, U-shaped, trapezoid-shaped and/or another cross-sectional contour formed in a way that is deemed expedient by a person having skill in the art. This allows achieving a constructively simple and hence cost-competitive implementation of the at least one drain wire receiving element.

Further it is proposed that the at least one drain wire receiving element is arranged at least partly on an exterior side of the at least one wiring block. In this way an in particular electrical contacting of the drain wire is achievable, preferably after an advantageously short distance, in an advantageously simple manner. This allows achieving an advantageously good shielding.

It is moreover proposed that the at least one drain wire receiving element is provided for guiding the drain wire at least partly in an axial direction and in a radial direction. The axial direction preferably extends at least substantially in parallel to the introduction direction of the data cable. "At least substantially in parallel" is to mean, in this context, in particular that the axial direction and the introduction direction include an angle which is in particular no more than 10 degrees, preferably maximally 5 degrees, preferentially no more than 3 degrees and particularly preferably maximally 1 degree. The radial direction preferably extends at least substantially perpendicularly to the introduction direction of the data cable. "At least substantially perpendicularly" is to mean, in this context, in particular that the radial direction and the introduction direction include an angle deviating from a right angle by maximally 10 degrees, preferably no more than 5 degrees, preferentially maximally 3 degrees and particularly preferably no more than 1 degree. This allows achieving an advantageously reliable guidance of the drain wire.

It is furthermore proposed that the plug connector device comprises at least one contact element, which is provided for electrically contacting the drain wire received in the at least one drain wire receiving element in an assembled state. In this way an in particular electrical contacting of the drain wire and an advantageously good and preferably interference-free data transmission are achievable in an advantageously simple manner.

Moreover it is proposed that the plug connector device comprises at least one housing, which is provided for at least partly encompassing the wiring block in an assembled state, and comprises at least one wiring cover, which is pivotably arranged at the at least one housing. By the term "at least partly encompassing" is to be understood, in this context, in particular that the housing encompasses at least the wiring block in at least one plane, preferably in at least two planes that are arranged pitched to each other, over an angle range in particular of more than 180 degrees, preferably of more than 270 degrees and particularly preferentially of 360 degrees. "Pivotably" is to mean, in this context, in particular that the wiring cover is at least partly supported in such a way that it is at least partly rotationally movable about a rotary axis. Preferably the wiring cover is supported pivotably about a rotary axis that is arranged perpendicularly with respect to the introduction direction of the data cable. This allows simple and comfortable and in particular toolless wiring.

Advantageously the at least one wiring cover is embodied in such a way that it is releasable from the at least one housing in at least one folded-open state. By "releasable" is to be understood, in this context, in particular "non-destructively separable". In a particularly preferred exemplary embodiment, the wiring cover is implemented in such a way that is at least partly, preferably completely releasable from the at least one housing in a toolless fashion. This allows achieving an advantageously operator-friendly and comfortable implementation of the wiring cover in a constructively simple manner.

It is also proposed that the at least one wiring cover comprises at least one supporting element, which is provided for pivotably supporting the at least one wiring cover at the housing and comprises at least one collar. By the term "pivotably supporting" is to be understood, in this context, in particular that the at least one wiring cover, in particular decoupled from an elastic deformation of the wiring cover, has at least one movement option about at least one axis by an angle that is in particular greater than 30 degrees, preferably greater than 45 degrees, preferentially greater than 60 degrees and especially preferably at least 90 degrees. A "collar" is to be understood, in this context, in particular as a geometric element, in particular an at least pitch-circle-shaped, preferably disk-shaped, geometric element, which is preferably embodied fixedly connected to, particularly preferably connected in a one-part implementation with, the at least one supporting element, and which at least partly has a radius that is greater than a radius of the at least one supporting element in particular by at least 10%, preferably at least 50%, preferentially no less than 75% and particularly preferentially at least 100%. This advantageously simply allows preferably reliably preventing a bending-out of lateral regions of the at least one wiring cover on which the at least one supporting element is at least partly arranged, in particular in a pivoting movement of the at least one wiring cover. Furthermore different wiring covers provided for different applications may be provided, and may be supported pivotably at the at least one housing.

Furthermore it is proposed that the plug connector device comprises at least one strain relief unit, which is arranged, in particular directly arranged, at the at least one wiring block and is provided for fixating the at least one data cable, with respect to the wiring block, at least partly in a force-fit and/or form-fit fashion in an assembly state, in particular in a state when the wires are mounted, to the at least one wiring block. "In a force-fit fashion" is to mean, in this context, in particular that a holding force between the strain relief unit and the at least one data cable is preferably transferred at least partly via a friction force between the strain relief unit and the at least one data cable. "In a form-fit fashion" is to mean in particular that adjacent surfaces of the strain relief unit and the at least one data cable exert onto each other a holding force acting in a normal direction of the surfaces. In particular, the strain relief unit and the at least one data cable are at least partly geometrically engaged into each other. This allows achieving a preferably reliable fixation of the at least one data cable.

It is also proposed that the at least one strain relief unit is provided for fixating the at least one data cable in at least two orientations differing by at least 45 degrees with respect to the at least one wiring block. In a particularly preferred embodiment the strain relief unit is provided for fixating the at least one data cable in at least two orientations differing in particular by at least 60 degrees, preferentially by at least 75 degrees and especially preferably by 90 degrees, with respect to the at least one wiring block. In this way an advantageously flexible fixation of the at least one data cable can be achieved with respect to the at least one wiring block.

In addition the at least one strain relief unit comprises at least one strain relief element, which is fixable on the at least one wiring block in at least two orientations differing by at least 45 degrees with respect to the at least one wiring block. In a particularly preferred exemplary embodiment, the strain relief element is fixable in at least two orientations differing in particular by at least 60 degrees, preferentially by at least 75 degrees and especially preferably by 90 degrees, with respect to the at least one wiring block. Preferably the at least one strain relief element can be releasably connected to the at least one wiring block and is fixable in the at least two orientations differing by at least 45 degrees via at least two strain relief element receptacles, which are provided on the at least one wiring block offset to each other by at least 45 degrees. It is however also conceivable that the at least one strain relief element can be brought into the two orientations differing by at least 45 degrees with respect to the at least one wiring block at least partly by a plastic deformation, e.g. bending by an operator. The at least one strain relief element is fixable in at least two, preferably in at least three and particularly preferably in at least four orientations, which are in an assembled state arranged distributed about the at least one data cable in a circumferential direction. This allows achieving a preferably flexible implementation of the at least one strain relief unit, which is adaptable to a variety of conditions.

Moreover it is proposed that the at least one strain relief unit comprises at least one strain relief element, which is embodied at least partly as a holding strap, as a result of which an advantageously simple, robust and cost-competitive implementation of the at least one strain relief element is achievable.

It is further proposed that the at least one strain relief unit comprises at least two latch elements, which in an assembled state correspond to the strain relief element for a fixation of the at least one data cable with respect to the wiring block. This allows achieving an advantageously flexible and preferably flexible fixation of the at least one data cable with respect to the at least one wiring block.

Furthermore a plug connector, in particular a plug socket, with at least one plug connector device is proposed.

BRIEF DESCRIPTION OF THE SEVERAL VIEWS OF THE DRAWING(S)

Further advantages will arise from the following description of the drawings. In the drawings two exemplary embodiments of the invention are shown. The drawings, the description and the claims contain a plurality of features in combination. The person having ordinary skill in the art will purposefully also consider the features separately and will find further expedient combinations.

Figure 2:
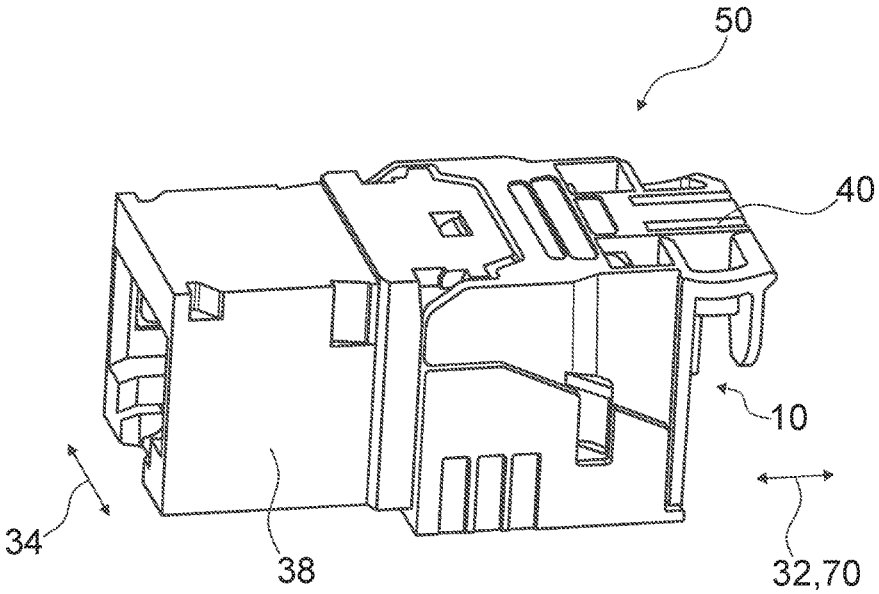
Figure 3:
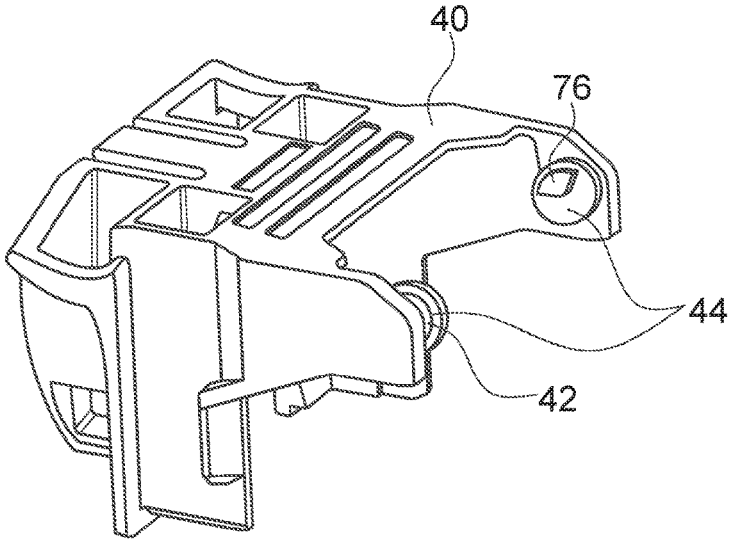
Figure 4:
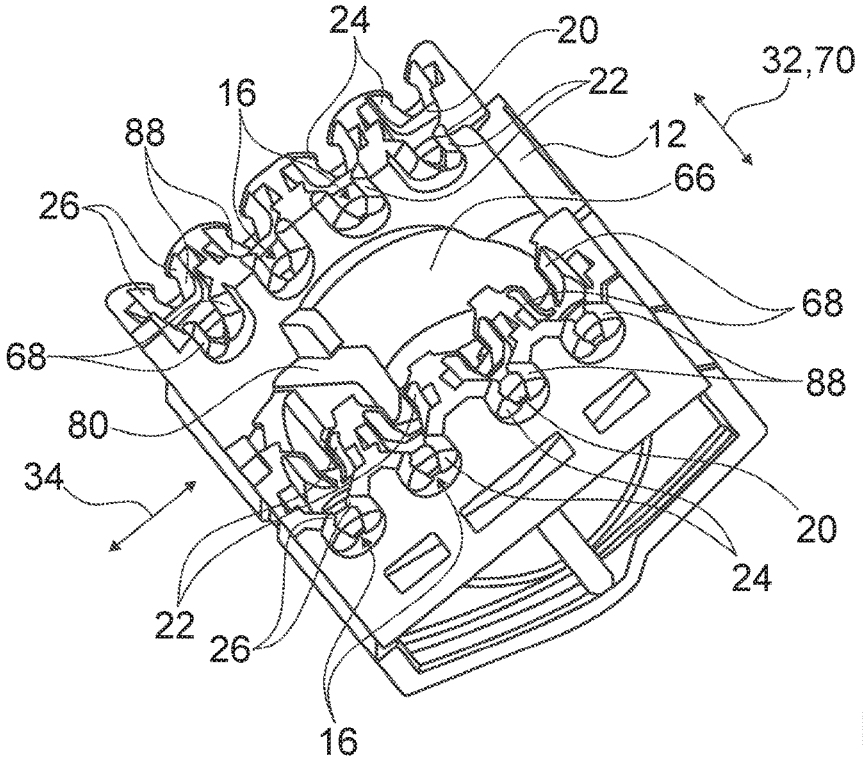
Figure 5:
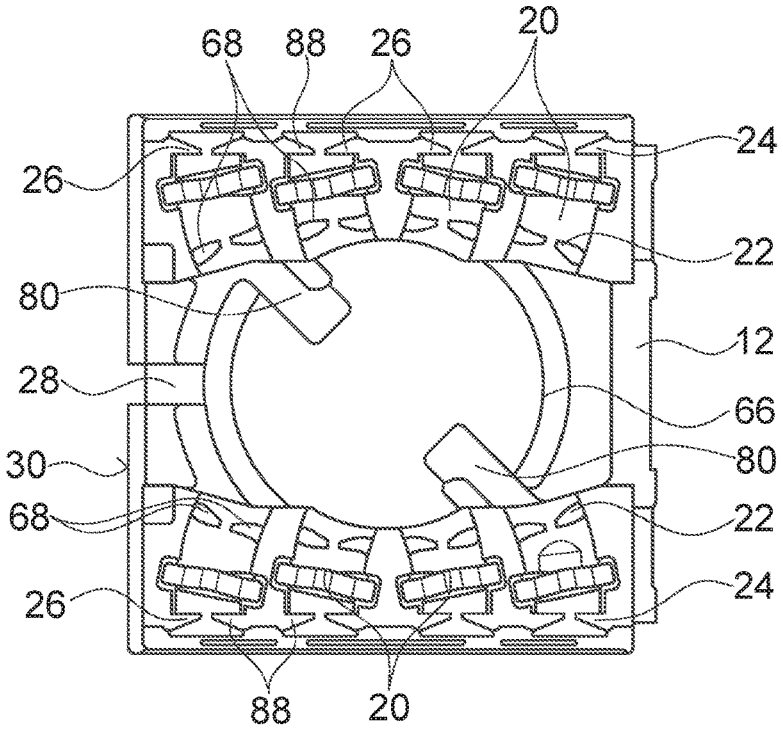
Figure 6:
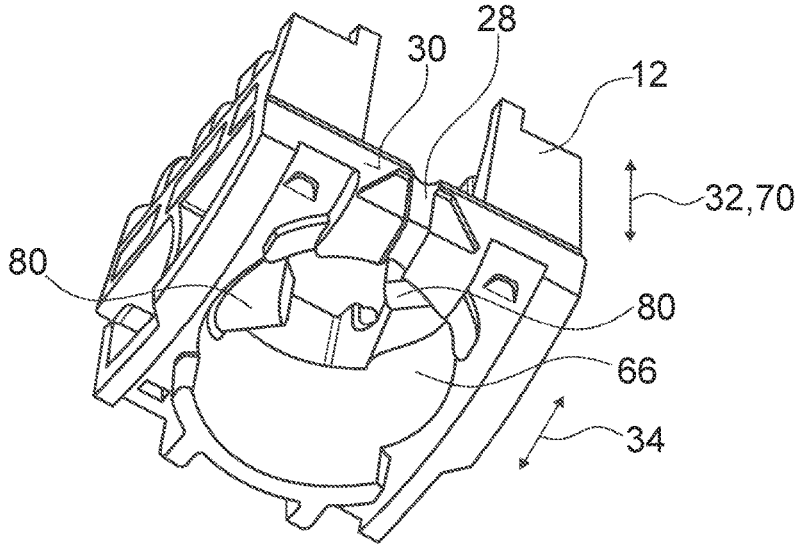
Figure 7:
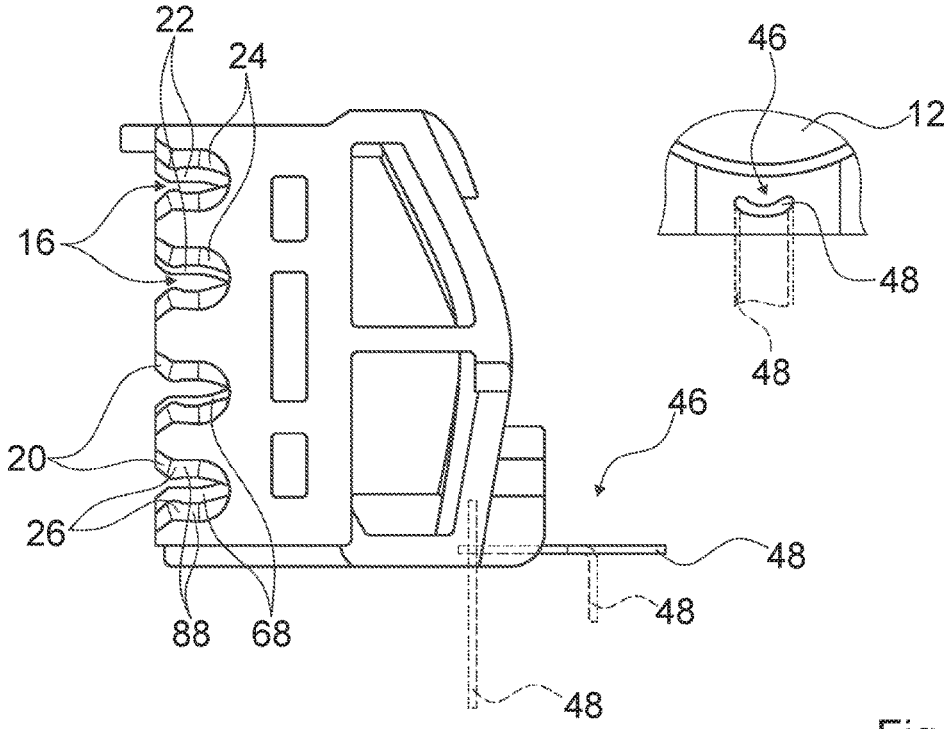
Figure 8:
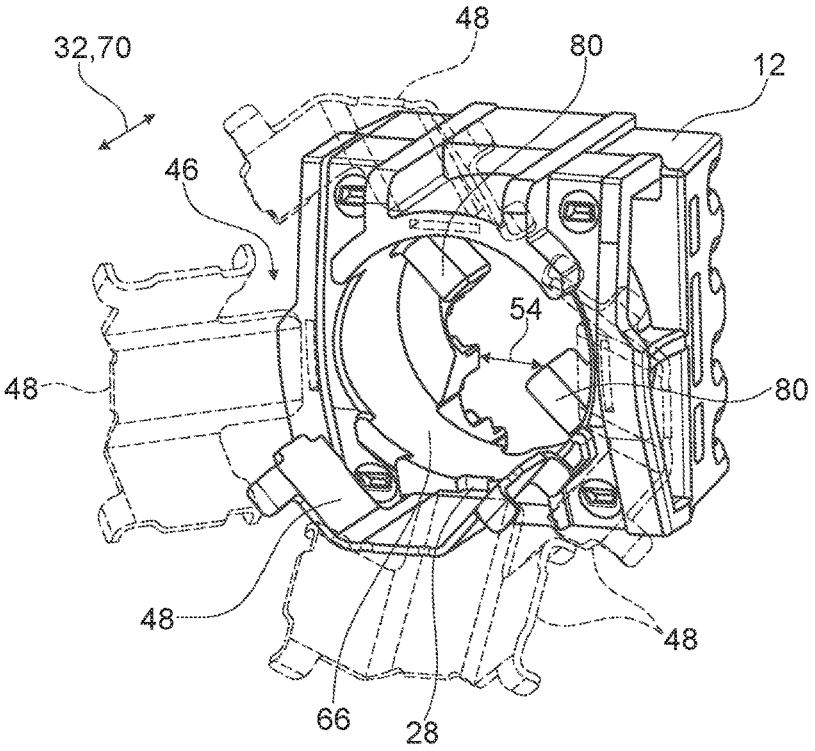
Figure 9:
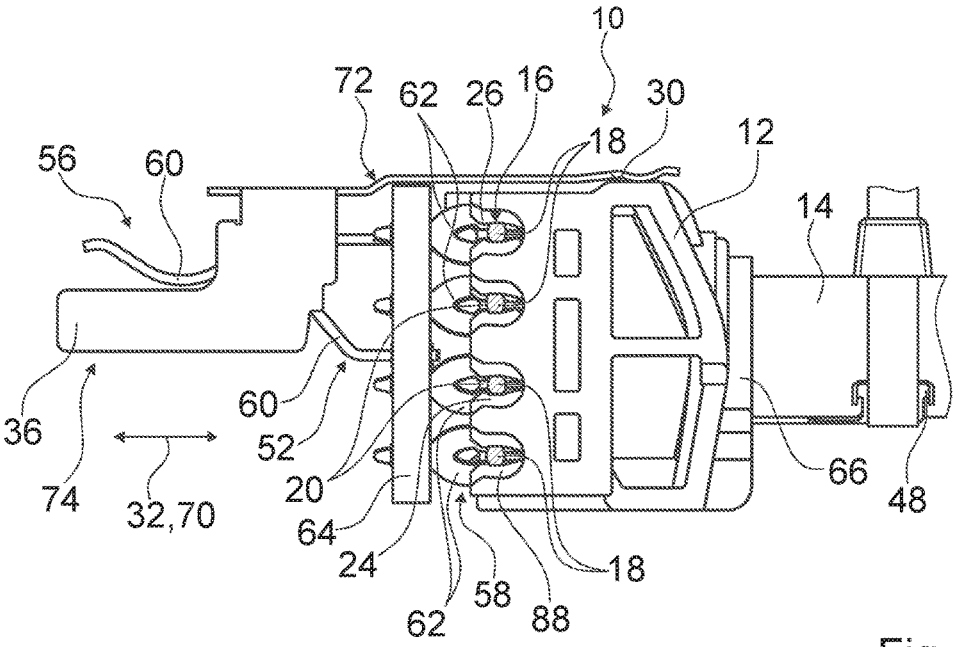
Figure 10:
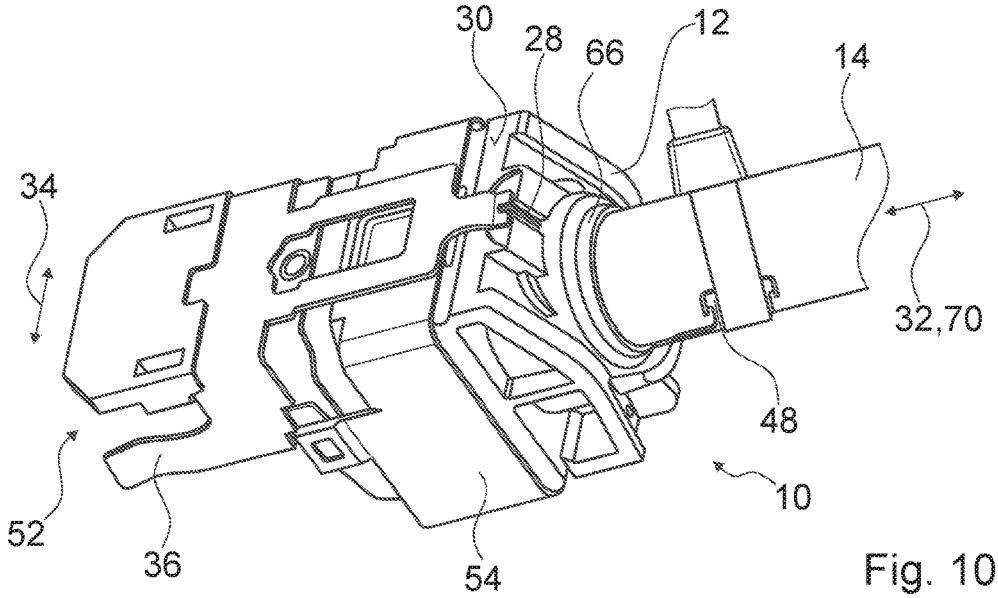
Figure 11:
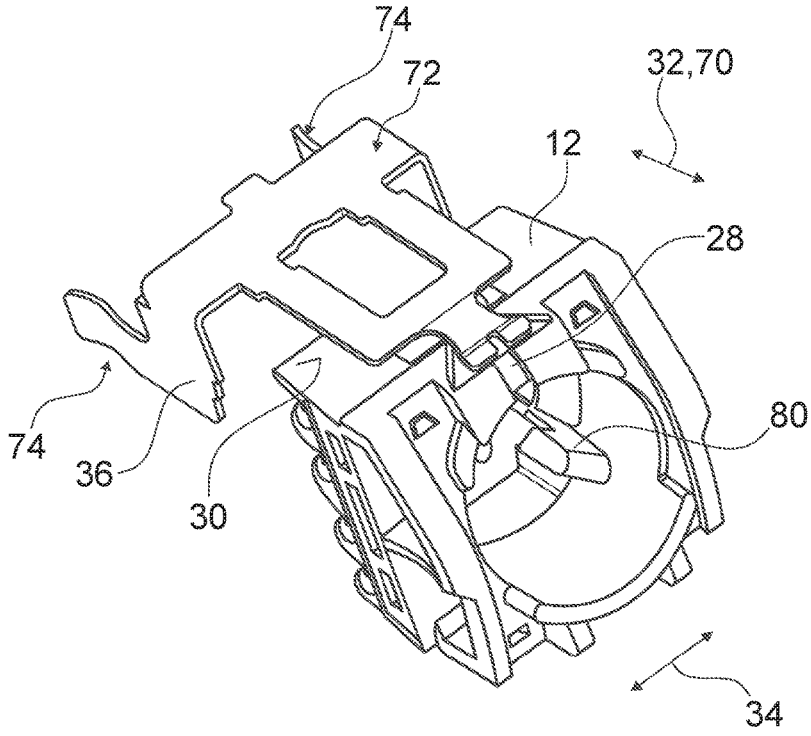
Figure 12:
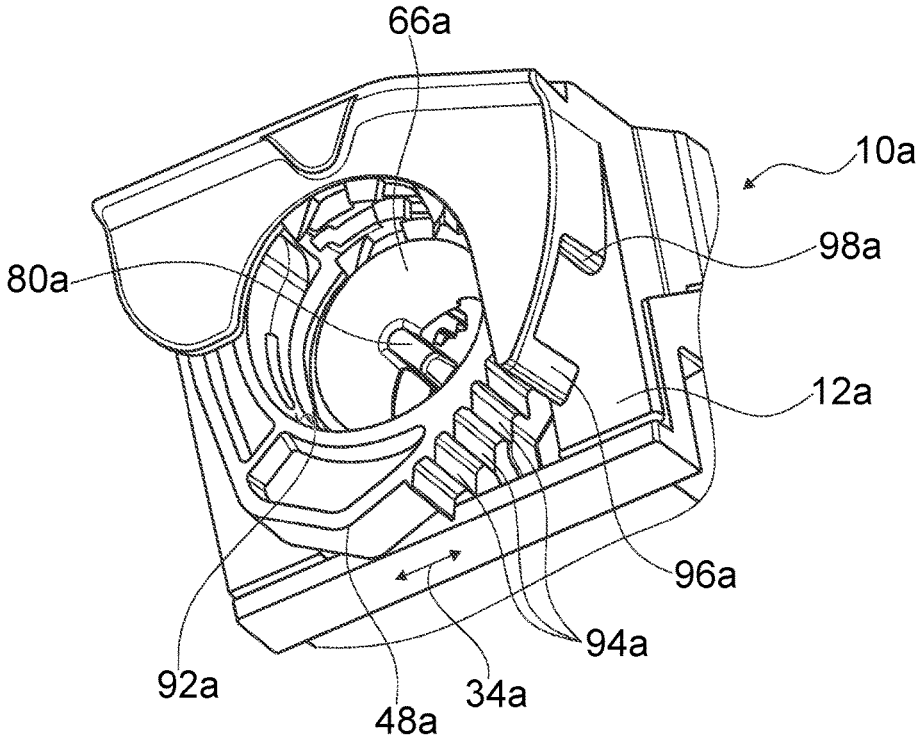
Figure 13:
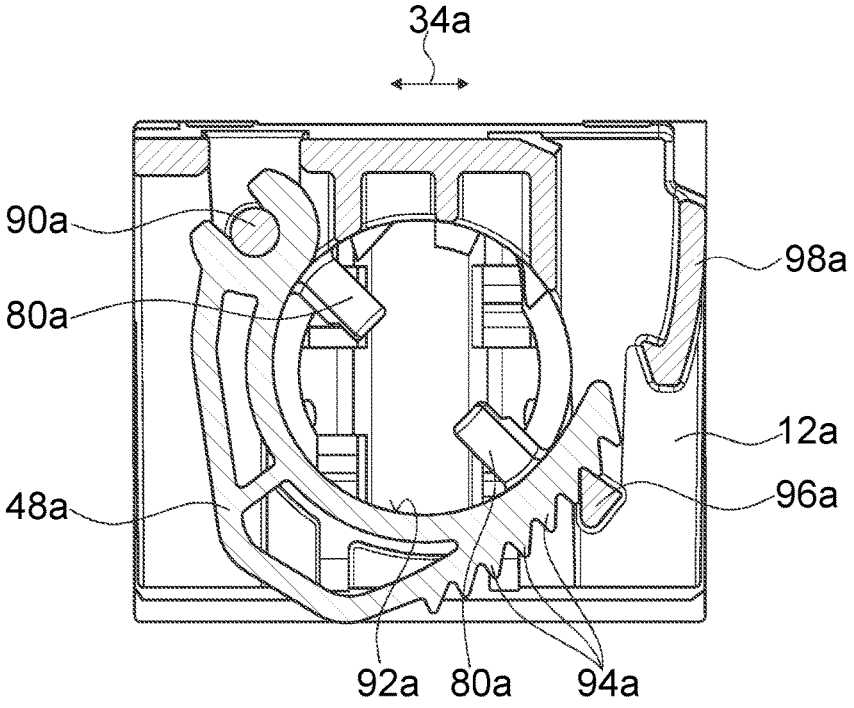

It is shown in:

FIG. 1 a plug connector with a plug connector device in an exploded view,

FIG. 2 the plug connector with the plug connector device in a perspective view, FIG. 3 a wiring cover of the plug connector device in a perspective view, FIG. 4 a wiring block of the plug connector device in a perspective view, FIG. 5 the wiring block of the plug connector device in a view from above, FIG. 6 the wiring block of the plug connector device, with a drain wire receiving element of the plug connector device, in a perspective view FIG. 7 the wiring block of the plug connector device, with a strain relief element of a strain relief unit of the plug connector device in a lateral view and a section in a front view, FIG. 8 the wiring block of the plug connector device, with the strain relief element of a strain relief unit of the plug connector device in different orientations, in a perspective view FIG. 9 the wiring block of the plug connector device, with a contact element of the plug connector device and with a plug contact unit of the plug connector, in a lateral view, FIG. 10 the wiring block of the plug connector device, with the contact element of the plug connector device and with the plug contact unit and an intermediary housing of the plug connector, in a perspective view, FIG. 11 the wiring block and the contact element of the plug connector device, in a perspective view, FIG. 12 an alternative implementation of the plug connector device, with a wiring block and an alternative strain relief unit, in a perspective view, and FIG. 13 the wiring block and the alternative strain relief unit in a sectional view.

DETAILED DESCRIPTION OF THE INVENTION

In FIGS. 1 and 2 a plug connector 50 is shown, which is embodied by a plug socket. The plug connector 50 is embodied as an RJ plug connector. The plug connector 50 is embodied as an RJ45 plug connector. It is however also conceivable that the plug connector 50 is embodied, for example, as an RJ11 plug connector or in another way that is deemed expedient by a person having ordinary skill in the art. The plug connector 50 is provided for corresponding with a data plug and for establishing in a plugged-in state of the data plug a data network connection. The plug connector 50 comprises a plug connector device 10 with a housing 38, a wiring block 12, a contact element 36 and a wiring cover 40 as well as a plug contact unit 52 and an intermediary housing 54. The plug connector device 10 is provided for receiving and fixating a multi-wire data cable 14. The multi-wire data cable 14 comprises eight wires 18 and a drain wire. However, an alternative data cable would also be conceivable, in which the drain wire is dispensed with. The data cable 14 may also comprise another number of wires 18, which is deemed expedient by a person having ordinary skill in the art. The wires 18 of the data cable 14 are pair-wise twisted with each other. The wires 18, which are arranged and twisted with each pair-wise, are encompassed by a wire-pair shielding, which is not shown. The wire-pair shielding is implemented by a foil in which the wires 18 are wrapped, which are arranged and twisted with each other in pairs. The wire-pair shielding is implemented of metal. The wire-pair shielding is implemented by a metal foil. The wire-pair shielding may in addition also be implemented at least partially of plastic. However, an alternative data cable is also conceivable, in which the wire-pair shielding is dispensed with. The drain wire runs approximately centrally in the data cable 14 between the wires 18, which are arranged and twisted with each other in pairs, and contacts the wire-pair shielding of the wires 18 of the data cable 14, which are pairwise arranged and twisted with each other. The data cable 14 may also comprise an exterior shielding. The data cable 14 further comprises an insulation encompassing in a circumferential direction the wires 18, which are arranged and twisted with each other in pairs, the wire-pair shielding of the latter, the drain wire and, if applicable, the exterior shielding.

The plug contact unit 52 comprises a first plug contact zone 56 which, in a plugged-in state of the data plug in the plug connector 50, establishes an electric contact directly between the data plug and the plug connector 50, and comprises a second plug contact zone 58, which in an assembled state of the plug connector 50 establishes an electric contact to wires 18 of the multi-wire data cable 14 that is coupled to the plug connector 50. In the first plug contact zone 56 of the plug contact unit 52 contact wires 60 are arranged which, in a plugged-in state of the data plug in the plug connector 50, are in a direct electric contact with the data plug. The first plug contact zone 56 comprises eight contact wires 60. The second plug contact zone 58 of the plug contact unit 52 comprises insulation displacement contacts 62 (IDC) which, in an assembled state of the plug connector 50, are in direct electric contact with the wires 18 of the multi-wire data cable 14. The plug contact unit 52 comprises eight insulation displacement contacts 62. However, a different number of the contact wires 60 and/or of the insulation displacement contacts 62, which is deemed expedient by a person having ordinary skill in the art, is also conceivable. The plug contact unit 52 further comprises a connection board 64, which is arranged between the first plug contact zone 56 and the second plug contact zone 58 and via which the contact wires 60 and the insulation displacement contacts 62 are electrically connected.

The intermediary housing 54 is implemented of a plastic material. In an assembled state of the plug connector 50, the intermediary housing 54 partly encloses the wiring block 12 and the plug contact unit 52. The housing 38 is provided for at least partly enclosing the wiring block 12 in an assembled state. The housing 38 partly encloses the plug connector device 10 as well as the plug contact unit 52, the contact element 36 and the intermediary housing 54 in a circumferential direction and partly forms an exterior surface of the plug connector 50. The housing 38 is made of a plastic material. As an alternative or additionally, however, other materials are also conceivable for the housing 38, which are deemed expedient by a person having ordinary skill in the art. The housing 38 has a shielding effect against in-coupling and out-coupling electric and/or magnetic fields, which is implemented in a shielded version of the housing 38 by means of the metallic housing 38 itself, and in an unshielded version (not shown) of the housing by means of an integrated metallic shielding foil. In said not shown, unshielded version it is also conceivable to realize the shielding foil by a plastics material reinforced with metal fibers or by another material that is deemed expedient by a person having ordinary skill in the art.

The wiring block 12 of the plug connector device 10 is provided for receiving the multi-wire data cable 14 (FIGS. 4 to 6). The plug connector device 10 may however also be provided for receiving two or more data cables 14. The wiring block 12 comprises a guiding element 66, which is provided for receiving and guiding the data cable 14. The guiding element 66 has a circular cross section. The guiding element 66 is embodied as a cylindrical recess. The guiding element 66 has a diameter of 9.5 mm. However, other measurements of the diameter of the guiding element 66, which are deemed expedient by a person having ordinary skill in the art, are also conceivable. For receiving data cables 14 having a substantially smaller diameter than the guiding element 66, a diameter-reducing element 84 can be inserted in the guiding element 66. The diameter-reducing element 84 is implemented as an accessory component that is embodied separately from the wiring block 12. The diameter-reducing element 84 is implemented in such a way that it can be releasably coupled to the guiding element 66. The diameter-reducing element 84 has a circular outer cross-sectional contour. The diameter-reducing element 84 has a cylinder-shaped outer contour. The diameter-reducing element 84 has an outer diameter of 9.5 mm. Further the diameter-reducing element 84 comprises four lamella elements (not shown). The lamella elements are elastically deformable. When the data cable 14 is introduced, the lamella elements are pushed outwards in an elastically resilient fashion, thus holding the data cable 14 in a force-fit manner.

The wiring block 12 of the plug connector device 10 comprises at least one receiving region 16 for receiving the wires 18 of the data cable 14. The wiring block 12 comprises a plurality of receiving regions 16 for receiving the wires 18 of the data cable 14. The wiring block 12 comprises eight receiving regions 16 for receiving the wires 18 of the data cable 14. The wiring block 12 is embodied of an electrically insulating material. The wiring block 12 is made of plastic. As an alternative or additionally, however, other materials deemed expedient by a person having ordinary skill in the art are also conceivable for the wiring block 12. The wiring block 12 of the plug connector device 10 comprises at least one at least partly deformable receiving element 20 for receiving the wires 18 of the data cable 14. The wiring block 12 comprises a plurality of receiving elements 20 for receiving the wires 18 of the data cable 14. The wiring block 12 comprises eight receiving elements 20 for receiving the wires 18 of the data cable 14. The receiving regions 16 of the wiring block 12 are at least partly delimited by at least one of the at least partly deformable receiving elements 20. The receiving regions 16 of the wiring block 12 are respectively delimited by one of the receiving elements 20. The receiving elements 20 are embodied in a one-part implementation with the wiring block 12. The receiving elements 20 and the wiring block 12 are produced in an injection-molding process.

Each of the receiving elements 20 comprises a first receiving piece 22 and a second receiving piece 24. The receiving element 20 is composed of the first receiving piece 22 and the second receiving piece 24. The first receiving piece 22 and the second receiving piece 24 of the receiving element 20 respectively form a partial region of the receiving element 20. The first receiving piece 22 and the second receiving piece 24 of the receiving element 20 delimit the receiving region 16 on two sides situated, if viewed in a radial direction 34 of the data cable 14, opposite each other. The first receiving piece 22 and the second receiving piece 24 of the receiving element 20 are arranged spaced apart if viewed in a radial direction of the data cable 14.

The first receiving piece 22 is embodied at least partly elastically deformable. The first receiving piece 22 is embodied at least partly lamellar. The first receiving piece 22 of the receiving element 20 comprises two lamellae 68, which are situated opposite each other and are embodied deformable. The lamellae 68 of the first receiving piece 22 of the receiving element 20 have a low material thickness. The lamellae 68 of the first receiving piece 22 have, viewed towards the wiring block 12, a decreasing distance. A smallest distance between the lamellae 68 of the first receiving piece 22 is shorter than a thickness, respectively diameter, of one of the wires 18 of the data cable 14.

The second receiving piece 24 is embodied at least partly elastically deformable. The second receiving piece 24 comprises at least one holding lug 26, which is provided at least partly for a force-fit and form-fit fixation of respectively one of the wires 18 of the data cable 14. The second receiving piece 24 of the receiving element 20 comprises two lamellae 88 arranged opposite each other and respectively having a holding lug 26, which are provided for a force-fit and form-fit fixation of respectively one of the wires 18 of the data cable 14. The lamellae 88 of the second receiving piece 24 of the receiving element 20 have a low material thickness. The lamellae 88 of the second receiving piece 24 have, viewed towards the wiring block 12, a decreasing distance. A smallest distance between the lamellae 88 of the second receiving piece 24 is shorter than a thickness respectively a diameter of one of the wires 18 of the data cable 14. The holding lugs 26 of the second receiving piece 24 have a smallest distance from each other which is shorter than the thickness respectively the diameter of one of the wires 18 of the data cable 14. The first receiving piece 22 and the second receiving piece 24 of the receiving element 20 are embodied having different rigidities. The first receiving piece 22 of the receiving element 20 is embodied at least partly more rigid than the second receiving piece 24 of the receiving element 20.

Due to the decreasing distance between the lamellae 68, 88 of the first receiving piece 22 and the second receiving piece 24, and to the elastic deformability of the first receiving piece 22 and the second receiving piece 24, wires 18 with different diameters can be reliably received and held.

In an assembly of the plug connector device 10, the data cable 14 is stripped in a first step. Then the stripped section of the data cable 14 is slid into the guiding element 66 of the wiring block 12 until an edge of the insulation of the data cable 14, which is still arranged on the data cable 14, abuts at least one stop element 80 of the wiring block 12, as a result of which the stripped section of the data cable 14 is arranged on a side of the guiding element 66 that faces the receiving regions 16 of the wiring block 12. The wiring block 12 comprises two stop elements 80 arranged on walls of the guiding element 66 which are situated opposite each other along a diameter of the guiding element 66. The stop elements 80 are embodied in a one-part implementation with the wiring block 12. The stop elements 80 protrude into the guiding element 66 of the wiring block 12 in a radial direction 34 of the data cable 14. The stop elements 80 are embodied rib-shaped. The stop elements 80 are furthermore provided for supporting and facilitating a threading-in or inserting of the stripped section of the data cable 14 while dividing up the pairwise arranged wires 18 approximately equally into two groups and thus pre-sorting the pairwise arranged wires 18.

In a slid-in state of the data cable 14 the pairwise twisted wires 18 of the data cable 14 are undone in the stripped section of the data cable 14 and are then each introduced into one of the receiving elements 20 separately. Respectively one wire 18 of the data cable 14 is introduced into respectively one of the receiving elements 20 perpendicularly to an introduction direction 70 of the data cable 14. For this purpose the wires 18 are, viewed in parallel to the introduction direction 70, inserted into the first receiving piece 22 and the second receiving piece 24 from above, and are pressed towards the wiring block 12 into the receiving elements 20. Herein the wire 18 is pressed between the lamellae 68 of the first receiving piece 22 of one of the receiving elements 20, as a result of which the lamellae 68 are deformed and fixate the wire 18 of the data cable 14 in a force-fit and form-fit fashion. The lamellae 68 of the first receiving piece 22 and the lamellae 88 of the second receiving piece 24 of one of the receiving elements 20 deform elastically. It is however also conceivable that, when the wire 18 of the data cable 14 is pressed in, the lamellae 68 of the first receiving piece 22 and the lamellae 88 of the second receiving piece 24 of one of the receiving elements 20 deform plastically or additionally rupture partly, the ruptured lamellae 68, 88 hooking into an insulation of the wire 18 of the data cable 14 and a particularly reliable fixation of the wire 18 of the data cable 14 being thus achievable. It is moreover also conceivable that the lamellae 68 of the first receiving piece 22 and the lamellae 88 of the second receiving piece 24 of the receiving elements 20 are embodied at least partly knife-like, as a result of which the lamellae 68 of the first receiving piece 22 and the lamellae 88 of the second receiving piece 24 at least partly cut into the insulation of the wires 18 in an inserted state. The lamellae 68 of the first receiving piece 22 and the lamellae 88 of the second receiving piece 24 partly cut into the insulation of the wires 18 in an inserted state, thus achieving a form-fit fixation of the wires 18. The lamellae 68 of the first receiving piece 22 and the lamellae 88 of the second receiving piece 24 are implemented sharp-edged and knife-shaped.

Further, when pressed into the receiving elements 20, the wires 18 are, viewed in parallel to the introduction direction 20, respectively inserted into the second receiving piece 24 from above and are pressed towards the wiring block 12 into the receiving elements 20, in such a way that the wire 18 is pressed between the space between the holding lugs 26 of the second receiving piece 24 of the receiving elements 20 and come to lie in a receiving region of the second receiving piece 24. The holding lugs 26 of the second receiving piece 24 secure the wire 18 of the data cable 14 against slipping out into the introduction direction 70 of the data cable 14. It is also conceivable that, alternatively or additionally, the first receiving piece 22 of the receiving elements 20 respectively comprise at least one holding lug. The wires 18 are cut off laterally flush with the wiring block 12 by means of a tool.

Then the wiring block 12 and the plug contact unit 52 are slid together in parallel to the introduction direction 70 of the data cable 14 in such a way that the insulation displacement contacts 62 of the second plug contact zone 58 of the plug contact unit 52 contact the wires 18 of the data cable 14 (FIG. 9). Respectively one of the insulation displacement contacts 62 engages in the slid-together state into respectively one depression, which is respectively encompassed by one of the receiving regions 16 and is, viewed in a radial direction 34, arranged between the first receiving piece 22 and the second receiving piece 24 of one of the receiving elements 20. Respectively one of the insulation displacement contacts 62 engages in the slid-together state into a wire 18 of the data cable 14, cutting into the insulation of the wire 18 of the data cable 14, as a result of which the insulation displacement contact 62 electrically contacts the wire 18. When sliding together and the insulation displacement contacts 62 cutting into the insulation of the wires 18 of the data cable 14, the wires 18 of the data cable 14 are respectively held by the first receiving piece 22 and the second receiving piece 24 of the receiving elements 20 and are secured against the wires 18 slipping off during the sliding together. By way of such double positioning of the wires 18 respectively by the first receiving piece 22 and the second receiving piece 24 of the receiving elements 20, an advantageously precise and constant wiring quality can be achieved via the insulation displacement contacts 62.

To prevent a slipping out of the data cable 14 in assembly of the wiring block 12, the plug connector device 10 comprises a strain relief unit 46 arranged on the wiring block 12, which is provided for fixating the data cable 14 in an assembly state with respect to the wiring block 12 in a force-fit fashion (FIG. 7). It is however also conceivable that the strain relief unit 46 is provided for fixating the data cable 14, as an alternative or additionally, in a form-fit manner. The strain relief unit 46 is arranged directly or indirectly on the wiring block 12. The strain relief unit 46 comprises a strain relief element 48 and a fixation element. The strain relief element 48 is implemented by a metal sheet. The strain relief element 48 is implemented groove-shaped. The strain relief element 48 is implemented trough-shaped. The strain relief element 48 has a pitch-circle shaped cross-section. However, other implementations of the strain relief element 48 deemed expedient by a person having ordinary skill in the art are also conceivable, e.g. with a V-shaped cross-section. The fixation element is embodied by a cable tie (FIG. 10). However, other implementations of the fixation element deemed expedient by a person having ordinary skill in the art are also conceivable.

For fixating the data cable 14 the data cable 14 is guided along the strain relief element 48 and is then firmly strapped and fixated by means of the fixation element that engages around the strain relief element 48 and the data cable 14. The strain relief unit 46 is provided for fixating the data cable 14 in at least one position with respect to the wiring block 12. The strain relief unit 46 is provided for fixating the data cable 14 in at least two orientations that differ by at least 45 degrees with respect to the wiring block 12. The strain relief unit 46 is provided for fixating the data cable 14 in two orientations that differ by 90 degrees with respect to the wiring block 12. The strain relief element 48 of the strain relief unit 46 is fixedly connected to the wiring block 12. The strain relief element 48 of the strain relief unit 46 is connected to the wiring block 12 in a form-fit fashion. As an alternative or additionally, it is however also conceivable that the strain relief element 48 is connected to the wiring block 12 by substance-to-substance bond or in a force-fit fashion. The strain relief element 48 of the strain relief unit 46 can be brought by a plastic deformation, e.g. bending by an operator, into the two orientations that differ by 90 degrees with respect to the wiring block. It is also conceivable to bring the strain relief element 48 of the strain relief unit 46 into orientations differing with respect to the wiring block 12 by another angle measurement, e.g. 30 degrees, 45 degrees or 60 degrees, via a plastic deformation.

As an alternative it is also conceivable that the strain relief element 48 of the strain relief unit 46 is connected to the wiring block 12 releasably. The strain relief element 48 of the strain relief unit 46 can be connected to the wiring block 12 in such a way that it is toollessly releasable. The strain relief element 48 of the strain relief unit 46 may in an assembled state be inserted in a strain relief element receptacle 82, which is introduced into the wiring block 12.

Moreover the strain relief element 48 of the strain relief unit 46 may be provided to be fixated in one of in total four orientations which differ by 90 degrees and are arranged in an assembled state distributed around the data cable 14 (FIG. 8, depicted by dashed line). For this purpose four strain relief element receptacles 82 are provided on the wiring block 12, which are embodied slot-shaped and in which the strain relief element 48 can be inserted. However, another number of strain relief element receptacles 82 on the wiring block 12, e.g. one, two, three or more, are also conceivable. The strain relief element receptacles 82 are arranged, in an axial view direction, at 3 o'clock, 6 o'clock, 9 o'clock and 12 o'clock. In a delivery status of the plug connector device 10, the strain relief element 48 of the strain relief unit 46 is arranged on the wiring block 12 in the strain relief element receptacle 82, in an axial view direction, at 6 o'clock. However, other arrangements of the strain relief element receptacles 82 on the wiring block 12 deemed expedient by a person skilled in the art are also conceivable. It is however also conceivable that, in one of the orientations differing in a circumferential direction, the strain relief element 48 of the strain relief unit 46 is fixedly connected to the wiring block 12.

It is furthermore also conceivable that the strain relief element 48 of the strain relief unit 46 is embodied in such a way that it is fixable on the wiring block 12 in at least two orientations differing by at least 45 degrees with respect to the wiring block 12. The strain relief element 48 of the strain relief unit 46 may be embodied in such a way that it is fixable on the wiring block 12 in two orientations differing by 90 degrees with respect to the wiring block 12. The strain relief element 48 can be embodied in such a way that it can be releasably connected to the wiring block 12. The strain relief element 48 can be embodied in such a way that it can be releasably connected to the wiring block 12 toollessly. The wiring block 12 can comprise at least two strain relief element receptacles 82, which are pairwise introduced in two sides of the wiring block 12 which are angled by at least 90 degrees. The strain relief element receptacles 82 are embodied slot-shaped. The strain relief element 48 is insertable into the strain relief element receptacles 82.

The wiring block 12 further comprises a drain wire receptacle element 28, which is provided for receiving a drain wire of the data cable 14 (FIG. 6). The drain wire receptacle element 28 is embodied groove-shaped. The drain wire receptacle element 28 is embodied trough-shaped. The drain wire receptacle element 28 has a pitch-circle shaped cross section. The drain wire receptacle element 28 is embodied in a one-part implementation with the wiring block 12. The drain wire receptacle element 28 is arranged at least partly on an exterior side 30 of the wiring block 12. The drain wire receptacle element 28 is provided for guiding the drain wire at least partly in an axial direction 32 and in a radial direction 34. The axial direction 32 extends in parallel to the introduction direction 70 of the data cable 14. The drain wire receptacle element 28 extends, viewed in parallel to the introduction direction 70 of the data cable 14, from a side of a wall of the wiring block 12 facing the receiving elements 20 towards and along the exterior side 30 of the wall of the wiring block 12 and then, viewed in parallel to the introduction direction 70 of the data cable 14, along a side of a wall of the wiring block 12 facing away from the receiving elements 20. The drain wire receptacle element 28 is embodied U-shaped if viewed in a main extension direction of the drain wire receptacle element 28.

In assembly the drain wire is guided by the guiding element 66, in which the data cable 14 is held, to the drain wire receptacle element 28 and is placed in the drain wire receptacle element 28 that is embodied groove-shaped and is guided in the drain wire receptacle element 28. In the drain wire receptacle element 28 the drain wire is guided U-shaped around a wall of the wiring block 12. By this arrangement of the drain wire receptacle element 28, a contacting of the drain wire after a short length of the drain wire and thus good shielding characteristics are achievable.

The plug connector device 10 further comprises the contact element 36, which is provided for electrically contacting the drain wire received in the drain wire receptacle element 28 (FIGS. 9 to 11). The contact element 36 is implemented of an electrically conductive material. The contact element 36 is implemented of a metal. The contact element 36 is implemented of a metal sheet. In an assembled state the contact element 36 covers part of the drain wire receptacle element 28 and contacts the drain wire guided in the drain wire receptacle element 28. The contact element 36 comprises a first region 72 contacting in an assembled state the drain wire, and comprises at least one second region 74, which is provided for directly contacting the data plug in a plugged-in state. The contact element 36 comprises two second regions 74. The second regions 74 of the contact element 36 are arranged in parallel. The second regions 74 of the contact element 36 are embodied L-shaped. The second regions 74 of the contact element 36 are implemented angled with respect to the first region 72 of the contact element 36. The second regions 74 of the contact element 36 are embodied angled by respectively 90 degrees with respect to the first region 72 of the contact element 36. The second regions 74 of the contact element 36 are arranged subsequently to the first region 72 of the contact element 36 on opposite sides of the first region 72 of the contact element 36. The contact element 36 partly encompasses the plug contact unit 52, the intermediary housing 54 and the wiring block 12. A portion of the first region 72 which faces away from the wiring block 12 and the second regions 74 of the contact element 36 partly engage around the first plug contact zone 56. The portion of the first region 72 facing away from the wiring block 12, and the second regions 74 of the contact element 36 engage around the first plug contact zone 56 in a U-shaped fashion. The contact element 36 is in an assembled state enclosed by the housing 38. The contact element 36 is embodied separate from the housing 38. It is however also conceivable that the contact element 36 is embodied at least partly or completely in a one-part implementation with the housing 38, and/or that the housing 38 is implemented at least partly or completely of an electrically conductive material, e.g. of a metal or a conductive plastics material.

The plug connector device 10 further comprises the wiring cover 40, which is pivotably supported at the housing 38 (FIG. 3). The wiring cover 40 is embodied in such a way that it is releasable from the housing 38 in a folded-open state. The wiring cover 40 is supported at the housing pivotably about an axis which runs perpendicularly to the introduction direction 70 of the data cable 14. The wiring cover 40 is embodied in a shielded version (not shown) of a metal and in an unshielded version of a plastics material. As an alternative or additionally, other materials deemed expedient by a person skilled in the art are also conceivable for the wiring cover 40, e.g. an electrically and/or magnetically shielding plastics material, which in particular comprises metal fibers but is not embodied electrically conductive, as a result of which a shielding effect against in-coupling and out-coupling electric and/or magnetic fields is achievable. It is moreover also conceivable that the wiring cover 40 comprises a shield embodied as a metal foil. The wiring cover 40 further comprises a supporting element 42, which is provided for pivotably supporting the wiring cover 40 at the housing 38 and which comprises at least one collar 44. The wiring cover 40 comprises two supporting elements 42. The supporting elements 42 of the wiring cover 40 are embodied as supporting bolts. The supporting elements 42 are embodied in a one-part implementation with the wiring cover 40. The supporting elements 42 respectively comprise the one collar 44. The collar 44 is respectively embodied disk-shaped. The collar 44 has a greater diameter than the respective supporting element 42. The collar 44 and the supporting element 42 have the same rotary axis. The collar 44 and the supporting element 42 are embodied in a one-part implementation. The wiring cover 40 comprises at least one conversion element 76, which is provided for at least partially converting a pivoting movement of the wiring cover 40 into a translatory movement. The conversion element 76 is provided for at least partially converting the pivoting movement of the wiring cover 40 into a translatory movement of the wiring block 12 towards the plug contact unit 52. The conversion element 76 is provided for transferring a force onto the wiring block 12 by way of a pivoting movement of the wiring cover 40. The wiring cover 40 comprises two conversion elements 76. Respectively one of the conversion elements 76 of the wiring cover 40 is arranged on a side of the collar 44 which respectively faces away from the supporting element 42. The collar 44 and the respective conversion element 76 are embodied in a one-part implementation. The conversion element 76 is embodied as a slotted-link guide.

For assembly the wiring cover 40 is slid into a slot-shaped receptacle 78 of the housing 38 perpendicularly to the introduction direction 70 of the data cable 14 and is then pivoted about the rotary axis of the supporting elements 42. Herein the collars 44 of the supporting elements 42 engage behind the receptacle 78 that is introduced in the housing 38 and can, in the pivoting movement of the wiring cover 40, prevent lateral regions of the wiring cover 40, on which the supporting elements 42 are arranged, from bending out. Due to the pivoting movement the wiring block 12 is pressed towards the plug contact unit 52 and the pivoting movement is thus converted into a translatory movement of the wiring block 12 via the conversion elements 76. Herein the insulation displacement contacts 62 engage into the receiving regions 16 of the wiring block 12 while cutting into the insulation of the wires 18 of the data cable 14, and are thus brought into electric contact to the wires 18 of the data cable 14.

As an alternative, it is also conceivable that the wiring cover 40 is implemented at least partly of a metal or is implemented reinforced at least in a region of the supporting elements 42, as a result of which a bending open of the wiring cover 40 in the pivoting movement of the wiring cover 40 can be prevented due to a high stability of the wiring cover 40 and the collar 44 can hence be dispensed with.

In FIGS. 12 and 13 a further exemplary embodiment of the invention is shown. The following description and the drawings are essentially limited to the differences between the exemplary embodiments, wherein regarding identically designated structural components, in particular regarding structural components having the same reference numerals, principally the drawings and/or the description of the other exemplary embodiment, in particular FIGS. 1 to 11, may be referred to. For distinguishing between the exemplary embodiments, the letter a is set subsequently to the reference numerals of the exemplary embodiment in FIGS. 12 and 13.

In FIGS. 12 and 13 a further implementation form of a strain relief unit **46*a* of a plug connector device 10*a* is shown. The plug connector device 10*a* largely corresponds to the plug connector device 10 described above. The strain relief unit 46*a* is provided for preventing a data cable 14*a* from slipping out when a wiring block 12*a* of the plug connector device 10*a* is assembled. The strain relief unit 46*a* is provided for fixating the data cable 14*a* in an assembly state with respect to the wiring block 12*a* in a force-fit and/or form-fit manner. The strain relief unit 46*a* comprises a strain relief element 48*a*. The strain relief element 48*a* is implemented of plastic. An implementation of the strain relief element 48*a* of a metal sheet or metal cast, but also as a metal component around which plastics material has been injection-molded is also conceivable. The strain relief element 48*a* of the strain relief unit 46*a* is embodied as a holding strap. The strain relief element 48*a* of the strain relief unit 46*a* is fixated to the wiring block 12*a* of the plug connector device 10*a*. The strain relief element 48*a* of the strain relief unit 46*a* is releasably fixated to the wiring block 12*a* of the plug connector device 10*a*. The strain relief element 48*a* of the strain relief unit 46*a* is fixated to the wiring block 12*a* in a form-fit manner. The strain relief element 48*a* is fixated to a fixation element 90*a*, which is arranged on the wiring block 12*a* of the plug connector device 10*a*. The fixation element 90*a* is embodied pin-shaped. However other implementations of the fixation element 90*a*, which are deemed expedient by a person having skill in the art, are also conceivable. The strain relief element 48*a* is supported pivotably about the fixation element 90*a*. The strain relief element 48*a* is releasably connected to the fixation element 90*a* of the wiring block 12*a***.

The strain relief element **48*a* of the strain relief unit 46*a* comprises an abutment surface 92*a*, which in an assembled state abuts an insulation of the data cable 14. The strain relief element 48*a* comprises radial ribs on the abutment surface 92*a*, which establish a form-fit connection to the data cable 14*a*. The strain relief element 48*a* of the strain relief unit 46*a* comprises a latching region, which is situated opposite the abutment surface 92*a* and comprises a plurality of latch teeth 94*a*. The latch teeth 94*a* are embodied corresponding to at least one latch element 96*a*, 98*a*, which is arranged on the wiring block 12*a* of the plug connector device 10*a*. The wiring block 12*a* comprises two latch elements 96*a*, 98*a*. The latch elements 96*a*, 98*a* are, viewed in a latching direction of the strain relief element 48*a***, arranged subsequently to each other and spaced apart.

In an assembled state the strain relief element **48*a* engages around the data cable 14*a* and is securely strapped. A form-fit and/or force-fit connection retain/retains the data cable 14*a* in the intended space permanently. For fixating a data cable 14*a* having a large diameter, the latch teeth 94*a* of the strain relief element 48*a* of the strain relief unit 46*a* correspond to the first latch element 96*a* and latch with said first latch element 96*a* until the data cable 14*a* is secured against slipping off with respect to the strain relief element 48*a* in a force-fit and/or form-fit fashion. The latching connection between the latch teeth 94*a* of the strain relief element 48*a* of the strain relief unit 46*a* and the latch elements 96*a*, 98*a* of the wiring block 12*a* is implemented in such a way that it is releasable. For the purpose of releasing the latching connection between the latch teeth 94***a* of the strain relief element 48*a* of the strain relief unit 46*a* and the latch elements 96*a*, 98*a* of the wiring block 12*a*, the strain relief element 48*a* is pressed inwards through an opening that is arranged between the first latch element 96*a* and the second latch element 98*a* of the wiring block 12*a*, and is thus put into operation. The strain relief element 48*a* is pressed inwards through the opening between the first latch element 96*a* and the second latch element 98*a* of the wiring block 12*a* manually or by means of a screw driver or of another tool deemed expedient by a person having ordinary skill in the art, and is thus put into operation.

REFERENCE NUMERALS

10 plug connector device
12 wiring block
14 data cable
16 receiving region
18 wire
20 receiving element
22 receiving piece
24 receiving piece
26 holding lug
28 drain wire receiving element
30 exterior side
32 axial direction
34 radial direction
36 contact element
38 housing
40 wiring cover
42 supporting element
44 collar
46 strain relief unit
48 strain relief element
50 plug connector
52 plug contact unit
54 intermediary housing
56 plug contact zone
58 plug contact zone
60 contact wires
62 insulating displacement contacts
64 connection board
66 guiding element
68 lamella
70 introduction direction
72 region
74 region
76 conversion element
78 receptacle
80 stop element
82 strain relief element receptacle
84 diameter-reducing element
88 lamella
90 fixation element
92 abutment surface
94 latch tooth
96 latch element
98 latch element

The invention claimed is:

1. A plug connector device, comprising:

at least one wiring block provided for receiving at least one multi-wire data cable, wherein the at least one wiring block includes at least one receiving region for receiving at least one wire of the at least one data cable, wherein the at least one receiving region is at least partly delimited by at least one receiving element, the at least one receiving element being at least partly deformable, wherein the at least one receiving element further includes at least one first receiving piece, the first receiving piece being implemented at least partly elastically and/or plastically deformable, wherein the at least one receiving element further includes at least one second receiving piece, the at least one second receiving piece having at least one holding lug, the at least one holding lug being at least partly provided for fastening respectively one wire of the at least one data cable in a form-fit manner, and the at least one first receiving piece at least partly having a first rigidity, the at least one second receiving piece at least partly having a second rigidity, and wherein the first rigidity and second rigidity are different rigidities.

2. The plug connector device according to claim 1, wherein one or both of the at least one first receiving piece and the at least one second receiving piece are at least partly lamellar.

3. The plug connector device at least according to claim 2, wherein the at least one first receiving piece and the at least one second receiving piece of the at least one receiving element are arranged spaced apart as viewed in a radial direction of the at least one data cable.

4. The plug connector device according to claim 1, wherein the at least one wiring block includes at least one drain wire receiving element, wherein the at least one drain wire receiving element is provided for receiving a drain wire of the at least one data cable.

5. The plug connector device according to claim 4, wherein the at least one drain wire receiving element is at least partly groove-shaped.

6. The plug connector device at least according to claim 4, wherein the at least one drain wire receiving element is arranged at least partly on an exterior side of the at least one wiring block.

7. The plug connector device at least according to claim 4, wherein the at least one drain wire receiving element is provided for guiding the drain wire at least partly in an axial direction and in a radial direction.

8. The plug connector device at least according to claim 4, further comprising at least one contact element, wherein the at least one contact element is provided for electrically contacting the drain wire received in the at least one drain wire receiving element in an assembled state.

9. The plug connector device at least according to claim 4, wherein the at least one drain wire receiving element is U-shaped as viewed in a main extension direction of the at least one drain wire receiving element.

10. The plug connector device at least according to claim 1, further comprising at least one housing, the at least one housing at least partly encompassing the at least one wiring block in an assembled state, and at least one wiring cover, wherein the at least one wiring cover is pivotably arranged at the at least one housing.

11. The plug connector device according to claim 10, wherein the at least one wiring cover is releasable from the at least one housing in at least one folded-open state.

12. The plug connector device at least according to claim 10, wherein the at least one wiring cover further includes at least one supporting element, the at least one supporting element pivotably supporting the at least one wiring cover at the at least one housing, and the at least one supporting element includes at least one collar.

13. The plug connector device according to claim 12, wherein the at least one collar of the at least one supporting element engages behind a receptacle that is introduced in the at least one housing, the at least one collar is adapted to, in the pivoting movement of the at least one wiring cover, prevent lateral regions of the at least one wiring cover, on which the at least one supporting element is arranged, from bending out.

14. The plug connector device according to claim 1, further comprising at least one strain relief unit, wherein the at least one strain relief unit is arranged at the at least one wiring block, and wherein the at least one strain relief unit is provided for fixating the at least one data cable with respect to the at least one wiring block at least partly in a force-fit and/or form-fit fashion in an assembled state.

15. The plug connector device according to claim 14, wherein the at least one strain relief unit is provided for fixating the at least one data cable in at least two orientations differing by at least 45 degrees with respect to the at least one wiring block.

16. The plug connector device according to claim 15, wherein the at least one strain relief unit includes at least one strain relief element, the at least one strain relief element is fixable on the at least one wiring block in at least two orientations differing by at least 45 degrees with respect to the at least one wiring block.

17. The plug connector device at least according to claim 14, wherein the at least one strain relief unit includes at least one strain relief element, the at least one strain relief element is at least partly a holding strap.

18. The plug connector device at least according to claim 14, wherein the at least one strain relief unit includes at least two latch elements, wherein the at least two latch elements in an assembled state correspond to the strain relief element for a fixation of the at least one data cable—with respect to the at least one wiring block.

* * * * *